US007219646B2

(12) United States Patent
Ueshima

(10) Patent No.: US 7,219,646 B2
(45) Date of Patent: May 22, 2007

(54) IN-LINE MULTICYLINDER COMBUSTION ENGINE

(75) Inventor: Atsushi Ueshima, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/929,166

(22) Filed: Aug. 30, 2004

(65) Prior Publication Data

US 2005/0045141 A1 Mar. 3, 2005

(30) Foreign Application Priority Data

Sep. 3, 2003 (JP) ..... 2003-311781

(51) Int. Cl.
*F02B 75/32* (2006.01)
*F02N 11/00* (2006.01)
*F02F 1/00* (2006.01)

(52) U.S. Cl. ..... 123/197.1; 123/193.1; 123/179.25; 123/195 AC; 123/195 E

(58) Field of Classification Search ..... None
See application file for complete search history.

(56) References Cited

U.S. PATENT DOCUMENTS 4,476,951 A 10/1984 Ito
5,495,833 A * 3/1996 Ishizaka et al. ..... 123/179.25

FOREIGN PATENT DOCUMENTS

| | | |
|---|---|---|
| JP | 58-065936 | 4/1983 |
| JP | 63-253122 | 10/1988 |
| JP | 2-248626 | 10/1990 |
| JP | 4-255530 | 9/1992 |
| JP | 2002-235548 | 8/2002 |
| JP | 1-233189 | 2/2006 |

* cited by examiner

*Primary Examiner*—Stephen K. Cronin
*Assistant Examiner*—Arnold Castro

(57) ABSTRACT

There is provided an in-line multicylinder combustion engine of a type, in which the length and the width of the combustion engine can be reduced; which can be assembled compact in size with its center of gravity lowered in position; in which mass centering in the combustion engine can be accomplished, The engine (E) includes a crankshaft (17), an input shaft (18) and an output shaft (19). The crankshaft (17) is connected with the input shaft (18) through a clutch gear (40). An imaginary plane (H) containing respective axes (70, 80) of the crankshaft (17) and the input shaft (18) lies substantially horizontally, while the axis (90) of the output shaft (19) is positioned above the imaginary plane (H). An electric generator (30) having a drive gear (52) is positioned adjacent the center of gravity (G) defined between the crankshaft (17) and the output shaft (19), with its generator longitudinal axis (30C) positioned above another imaginary plane (M) connecting between the respective axes (70, 90) of the crankshaft (17) and the output shaft (19). The drive gear (52) of the electric generator (30) is meshed with the clutch gear (40).

11 Claims, 5 Drawing Sheets

IN-LINE MULTICYLINDER COMBUSTION ENGINE

BACKGROUND OF THE INVENTION

1. Field of the Invention

The present invention generally relates to an in-line multicylinder combustion engine for use primarily in motorcycles and, more particularly, to provide the in-line multicylinder combustion engine of a kind that is assembled compact in size with its center of gravity lowered and that a relatively large banking angle can be obtained when such combustion engine is mounted on a motorcycle.

2. Description of the Prior Art

An in-line multicylinder internal combustion engine of a large engine displacement that is mounted on motorcycles has a substantial weight and, accordingly, efforts have been made to render the motorcycle as a whole to have a lower center of gravity by installing a crankshaft at a relatively low position such that the combustion engine has a lower center of gravity. In the in-line multicylinder combustion engine of the type referred to above, the combustion engine has a relatively large width because multiple engine cylinders are arranged in-line, that is, because the multiple engine cylinders are laid transverse relative to a motorcycle frame structure, and, accordingly, where an electric generator, generally known as dynamo, is disposed on one end of the crankshaft that is positioned in a lower region of the combustion engine, the lower region of the combustion engine tends to exhibit an increased width.

Also, it is well known that if a cylinder bore is designed to be large in size and a piston stroke is also designed to be short, the combustion engine can provide a high rotational speed, hence a large drive output. However, the larger the cylinder bore, the greater the total width of the combustion engine. Accordingly, considering also that the electric generator is disposed on one end of the crankshaft as discussed above, it is difficult to obtain a relatively large banking angle of the motorcycle frame structure. As a result thereof, increase of the size of the cylinder bores is difficult to achieve.

On the other hand, the Japanese Laid-open Publication No. 58-065936, for example, discloses an in-line multicylinder combustion engine of a design in which an electric generator is disposed not on one end of the crankshaft but at a rear side of an engine cylinder. According to this known design, the total width of the combustion engine can advantageously be reduced as compared with that of the engine design in which the electric generator is disposed on one end of the crankshaft and, accordingly, a relatively large banking angle of the motorcycle can be obtained.

However, where the crankshaft is arranged in line with input and output shafts as shown in FIG. 1 of the above discussed patent publication, it has been found that not only does the front-to-rear length or the longitudinal dimension of the combustion engine become great along with increase in weight thereof, but a wheelbase of the motorcycle also increases, resulting in an undesirable increase of the size and weight of the motorcycle.

Also, where the crankshaft and the output shaft are arranged level relative to each other with the input shaft positioned below them, the length of the combustion engine can be reduced, but the positioning of the crankshaft above the input shaft requires the electric generator, drivingly coupled with the crankshaft by means of a generally endless belt, to be positioned above the input shaft, shifting the center of gravity of the combustion engine to a higher position. With this design, setteing the center of gravity of the combustion engine at a lower position is difficult to achieve.

SUMMARY OF THE INVENTION

In view of the foregoing, the present invention is intended to provide an in-line multicylinder combustion engine of a type, in which when such a combustion engine is mounted on a motorcycle, a relatively large banking angle can be secured; and the length and the width of the combustion engine are reduced. The engine can be assembled compact in size with its center of gravity lowered; and in which mass centering occurs in the vicinity of the center of gravity of the combustion engine.

In order to accomplish the foregoing object of the present invention, there is provided an in-line multicylinder combustion engine which includes a crankshaft, an input shaft drivingly connected with the crankshaft through a clutch gear, an output shaft drivingly connected with the input shaft, and an electric generator.

The output shaft has an axis positioned above an imaginary plane containing respective axes of the crankshaft and the input shaft. Preferably, the imaginary plane containing the respective axes of the crankshaft and the input shaft lies substantially horizontally.

The electric generator has a drive gear and is positioned between the crankshaft and the output shaft with its axis positioned above an imaginary inclined plane containing the respective axes of the crankshaft and the output shaft. The drive gear of the electric generator is meshed with a coupling gear that is mounted on the input shaft and is constantly drivingly connected with the crankshaft.

Hence, according to the above structure, the positioning of the electric generator within a space defined above the plane containing the respective axes of the crankshaft and the output shaft is effective to reduce the total width of a lower region of the combustion engine as compared with the conventional layout in which the electric generator is arranged around one end of the crankshaft and, accordingly, when the combustion engine of the present invention is mounted on a motorcycle, a relatively large banking angle $\theta$ of the motorcycle relative to the road surface can be obtained.

Also, the input shaft, the output shaft and the crankshaft are arranged in a generally triangular layout with the crankshaft and the input shaft positioned below the level of the output shaft and, therefore, the center of gravity of the combustion engine can advantageously be lowered. Yet, not only because the total width of the combustion engine E is reduced, but also because the generally triangular layout assumed by the crankshaft, the input shaft and the output shaft affords reduction of the length of the combustion engine, the combustion engine as a whole can advantageously be assembled compact in size. In other words, comparing the combustion engine of the present invention with the conventional combustion engine for a given size of the combustion engine, the cylinder bores can have an increased diameter along with reduction in piston stroke so that a large output can be easily obtained from the combustion engine of the present invention.

Furthermore, since the electric generator is positioned above the plane containing the respective axes of the crankshaft and the output shaft, that is, in the vicinity of the rear surface of the cylinder block, centering of the mass, or an approach of a mass point of the generator to a mass point of the whole engine including the generator, can advantageously be accomplished, allowing the motorcycle with the combustion engine of the present invention mounted thereon to exhibit an increased overall performance.

Moreover, since the electric generator is of a design in which the drive gear is directly meshed with the coupling gear provided on the input shaft and is not of a type driven by a chain through sprockets, an undesirable increase of the number of component parts employed and that of the weight can advantageously be suppressed.

With this arrangement, both the crankshaft and the input shaft can occupy the lowest position thereby to further lower the center of gravity of the combustion engine.

In a preferred embodiment of the present invention, the in-line multicylinder combustion engine may also include a clutch mechanism having a clutch axis and disposed around the input shaft and positioned laterally of the combustion engine, and a starter motor having a motor axis. In this case, the electric generator and the starter motor are positioned closer to an intermediate portion of the combustion engine than the clutch mechanism, with the motor and starter longitudinal axes held radially close to each other.

According to this preferred design feature, not only the electric generator, but also the starter motor is positioned in the vicinity of the center of gravity of the combustion engine and, accordingly, mass centering in the combustion engine can advantageously be enhanced.

In another preferred embodiment of the present invention, the in-line multicylinder combustion engine may additionally include an engine casing including a cylinder block and a crankcase and made up of an upper casing component and a lower casing component, in which the crankshaft and the output shaft are positioned on a plane of joint interface between the upper and lower casing components.

The use of the engine casing made up of the upper and lower casing components defines a plane of joint interface between the upper and lower casing, with the crankshaft and the output shaft positioned on such plane. Accordingly, bearing holes for the crankshaft and the output shaft can easily be formed in the engine casing.

In a further preferred embodiment of the present invention, the coupling gear referred to above may be the clutch gear.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
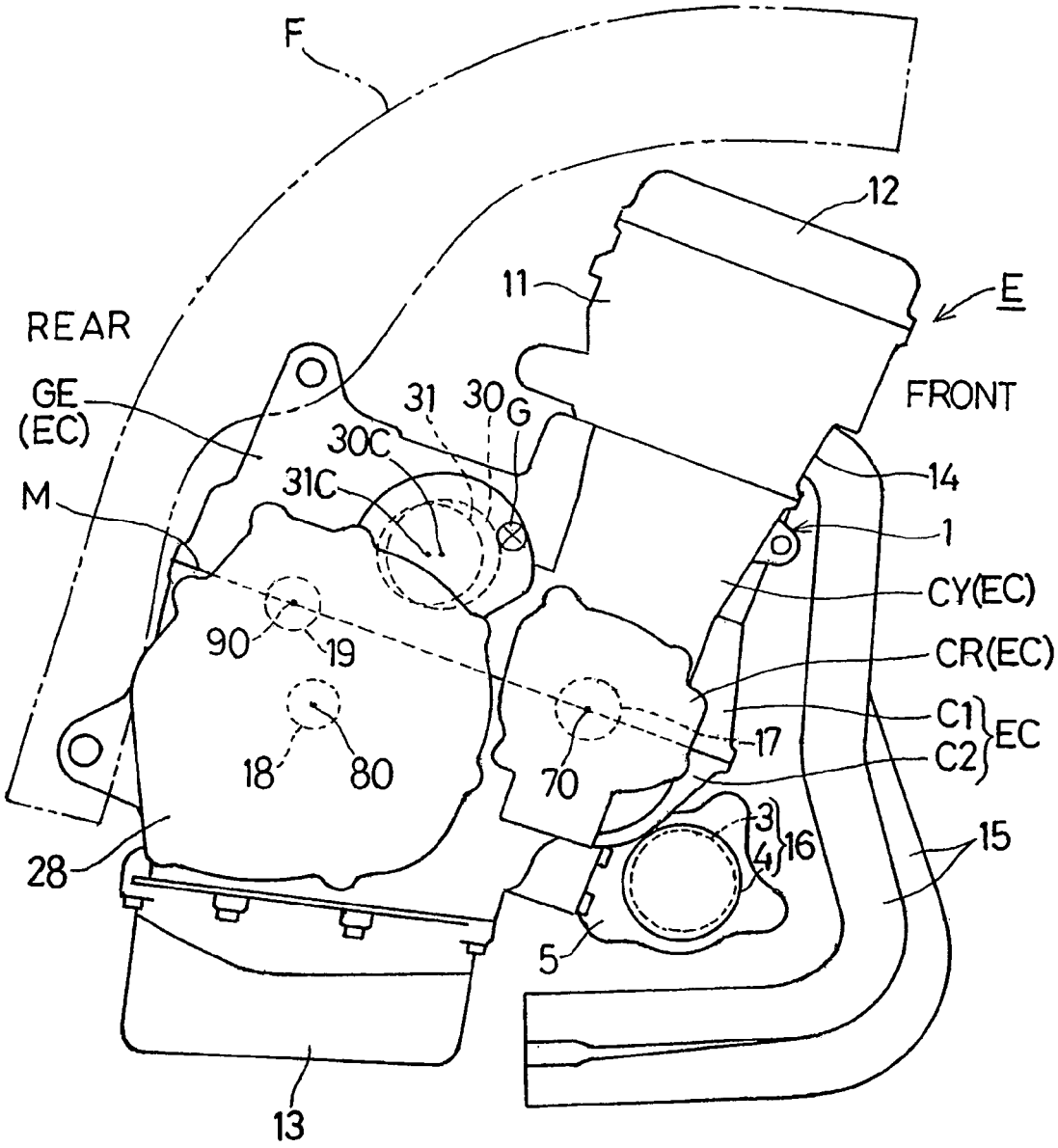
FIG. 1 is a side view of an in-line multicylinder internal combustion engine mounted on a motorcycle in accordance with a preferred embodiment of the present invention.

Hereinafter, a preferred embodiment of an in-line multicylinder internal combustion engine for a motorcycle in accordance with the present invention will be described in detail with reference to the accompanying drawings. Referring to FIG. 1 showing a side view of the in-line multicylinder internal combustion engine E for the motorcycle in accordance with one preferred embodiment of the present invention, the combustion engine E is an in-line four-cylinder, four-cycle engine and is mounted on a front lower portion of a motorcycle frame structure F. This motorcycle combustion engine E includes an engine body 1. The engine body 1 includes an engine casing EC made up of a crankcase CR, a cylinder block CY and a gear case GE. The engine casing EC is of a two-piece construction including an upper casing component C1 and a lower casing component C2. The cylinder block CY, an upper half portion of the crankcase CR and an upper half portion of the gear case GE are integrally formed in the upper casing component C1 while a lower half portion of the crankcase CR and an lower half portion of the gear case GE are integrally formed in the lower casing component C2.

A cylinder head 11 is fixedly mounted atop the cylinder block CY, and a cylinder head cover 12, with a valve chamber defined therein, is in turn mounted fixedly on a top surface of the cylinder head 11. An oil reservoir or oil pan 13 is secured to an undersurface of the lower casing component C2. As indicated above, the engine casing EC, the cylinder head 11, the cylinder head cover 12 and the oil pan 13 altogether constitute the engine body 1.

Figure 2:
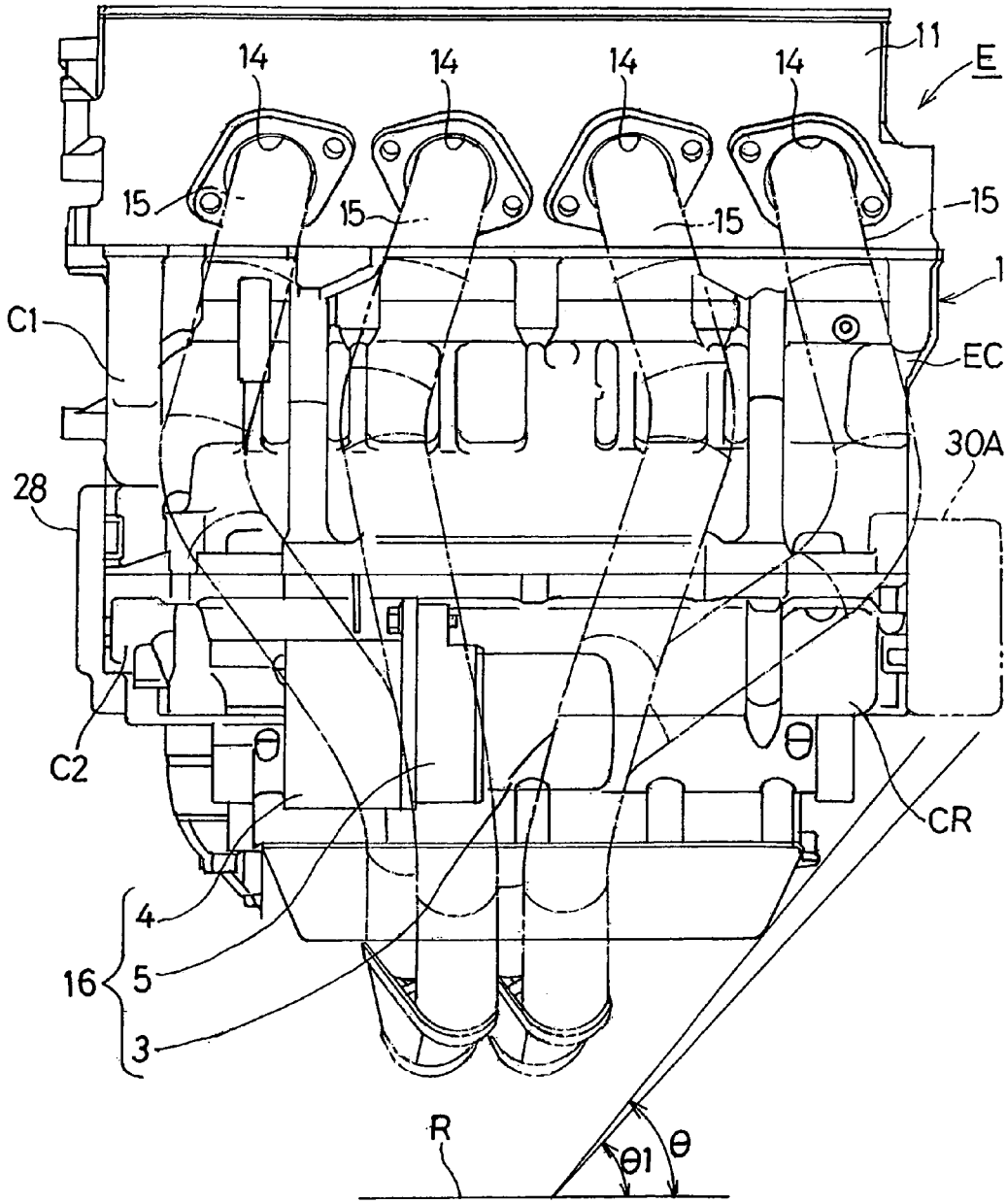
FIG. 2 is a front elevational view of the in-line multicylinder internal combustion engine.

Referring particularly to FIG. 2, the cylinder head 11 has four exhaust ports 14 fluidly connected with respective exhaust pipes 15. An electric generator or dynamo 30 and a starter motor 31 shown in FIG. 1 are disposed rearward of or at the rear side of the cylinder block CY, and an oil filter/cooler unit 16 made up of an oil filter 3 and an oil cooler 4 is mounted on a lower front surface of the combustion engine E through a mounting bracket 5.

Figure 3:
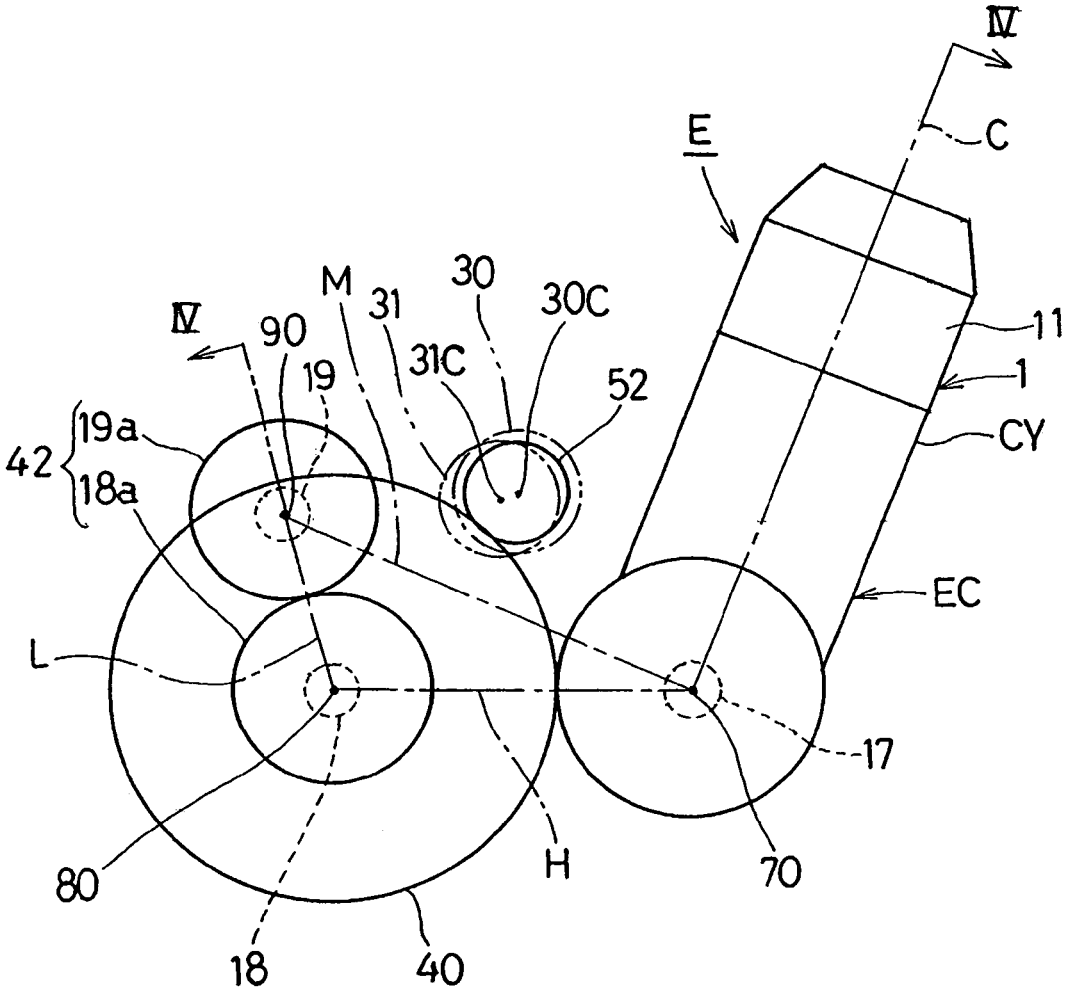
FIG. 3 is a schematic side view of the in-line multicylinder internal combustion engine, showing the relationship of a crankshaft, an input shaft and an output shaft employed therein.

The motorcycle combustion engine E also includes a crankshaft 17, an input shaft 18 drivingly engageable with the crankshaft 17 through a clutch gear 40 as will be described later and an output shaft 19 drivingly engageable with the input shaft 18. The input shaft 18 is a drive input shaft of a motorcycle transmission while the output shaft 19 is a drive output shaft of the motorcycle transmission. The crankshaft 17, the input shaft 18 and the output shaft 19 are geometrically arranged in a manner as shown in FIG. 3 when viewed from laterally of the motorcycle. Specifically, an imaginary plane H containing an axis 70 of the crankshaft 17 and an axis 80 of the input shaft 18 lies substantially horizontally with respect to a road surface R (FIG. 2) while an axis 90 of the output shaft 19 is positioned at a level above the imaginary plane H. In other words, the three shafts including the input shaft 18, the output shaft 19 and the crankshaft 17 are so arranged as to represent a generally triangular geometry, in which the imaginary plane M containing the respective axes 70 and 90 of the crankshaft 17 and the output shaft 19 is inclined forwardly downwardly with respect to the forward direction of run of the motorcycle while the input shaft 18 is positioned below the forwardly inclined imaginary plane M.

With the triangular geometry as described above, the crankshaft 17 is disposed at a lower level, resulting in the center of gravity G of the combustion engine E lowered. It is to be noted that the electric generator 30 is disposed at a location where it does not interfere with a reduction gear train 42 having an input gear 18*a* fixedly mounted on the input shaft 18 and an output gear 19*a* fixedly mounted on the output shaft 19.

As shown in FIG. 1, the forwardly inclined imaginary plane M coincides with an interface at which the upper casing component C1 and the lower casing component C2 of the engine casing EC are jointed together, with the longitudinal axes 70 and 90 of the shafts 17 and 19 positioned on the imaginary plane M, while the electric generator 30 and the input shaft 18 are positioned in the upper casing component C1 and the lower casing component C2, respectively. As shown in FIG. 3, a center axis of the cylinder block CY, that is, the longitudinal axis C of the cylinder block CY lies substantially perpendicular to the plane M of the joint between the upper and lower casing components C1 and C2, and accordingly, cylinder bores in the cylinder block CY can advantageously easily be machined.

Figure 4:
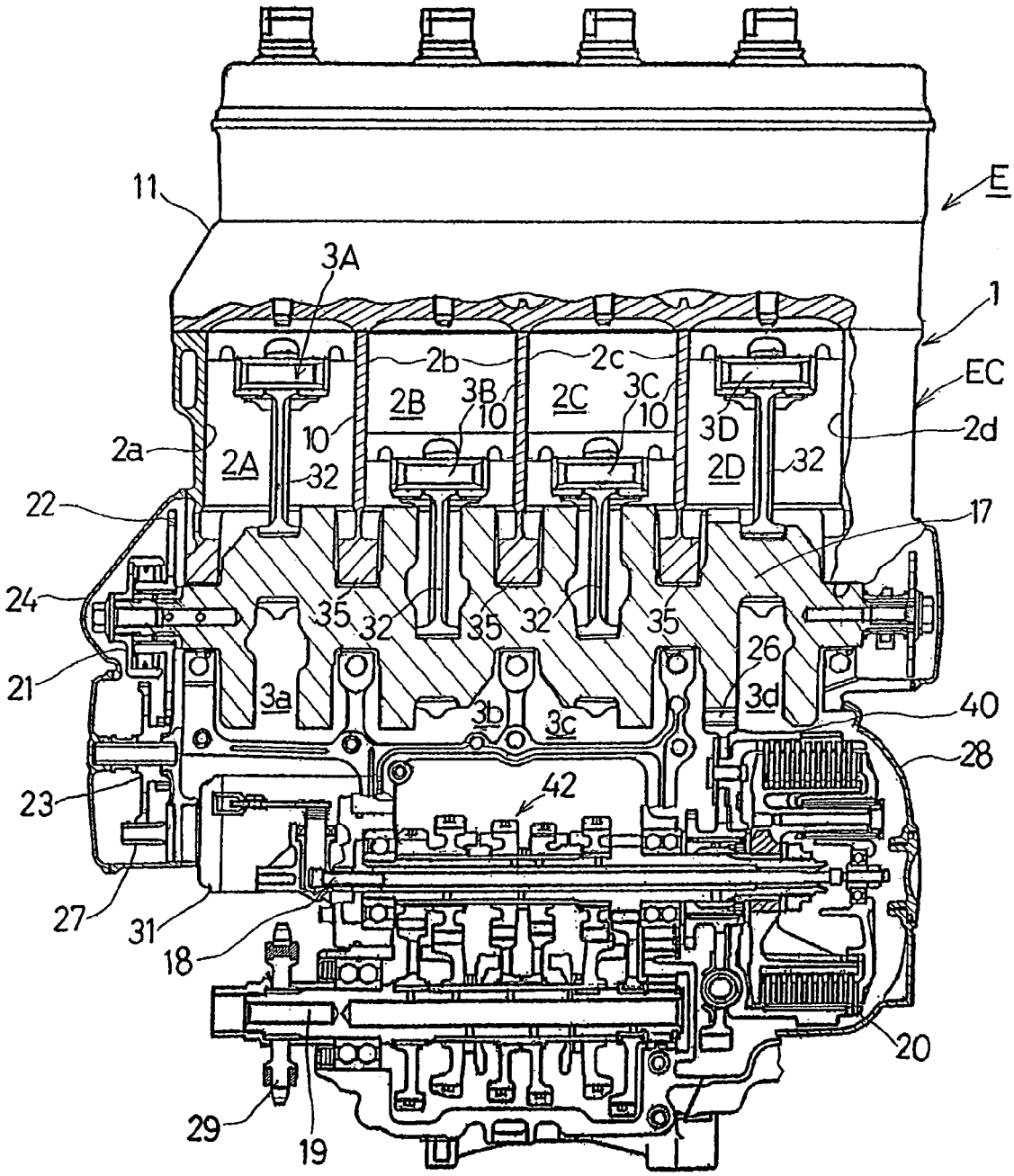
FIG. 4 is a cross-sectional view taken along the line IV—IV in FIG. 3.

FIG. 4 illustrates a cross-sectional view taken along the line IV—IV shown in FIG. 3, which is depicted as extending, through the longitudinal center axis C of the cylinder block CY, along an imaginary plane H containing the respective axes 70 and 80 of the shafts 17 and 18 and also along the imaginary plane L containing the respective longitudinal axes 80 and 90 of the input and output shafts 18 and 19. As shown in FIG. 4, the engine casing EC positioned below the cylinder head 11 has four cylinders 2A, 2B, 2C and 2D defining respective cylinder bores 2*a*, 2*b*, 2*c* and 2*d* and also has a crankcase CR defining four crank chambers 3*a*, 3*b*, 3*c* and 3*d*, which cylinder bores 2*a* to 2*d* and crank chambers 3*a* to 3*d* are partitioned by associated partition walls 10 such that the crank chambers 3*a* to 3*d* are in communication with the cylinder bores 2*a* to 2*d*.

Reciprocating piston 3A, 3B, 3C and 3D are reciprocatingly movably accommodated within the cylinder bores 2*a* to 2*d* of the cylinders 2A to 2D, respectively. A crankshaft bearing 35 is provided on a lower portion of each of the partition walls 10. The reciprocating pistons 3A to 3D are drivingly connected with the crankshaft 17 through respective connecting rods 32.

A starter gear 22 is mounted on one of opposite ends of the crankshaft 17, for example, a left end thereof as viewed in FIG. 4, through a one-way clutch 21 and is drivingly meshed with an idle gear 23 that is positioned adjacent such starter gear 22. The one-way clutch 21 and the starter and idle gears 22 and 23 are covered by a generally bowl-shaped cover 24.

Adjacent the other end (a right end) of the crankshaft 17 there is provided a drive gear 26 that is drivingly meshed with the clutch gear 40. A clutch mechanism 20 including the clutch gear 40 is mounted on one end of the input shaft 18 and positioned laterally of the combustion engine E. This clutch mechanism 20 is operable to selectively engage and disengage the clutch gear 40 with and from the input shaft 18, respectively. In parallel with the input shaft 18, the output shaft 19 engageable therewith through the reduction gear train 42 is disposed. The starter motor 31 is disposed at a location laterally of the combustion engine E at the rear of the cylinder block CY and has a drive gear 27 formed on the starter motor 31 and protruding laterally outwardly from the starter motor 31. The drive gear 27 is drivingly connected with the crankshaft 17 through the idle gear 23, the starter gear 22 and the one-way clutch 21. The clutch mechanism 20 is covered by a clutch cover 28 and an output chain sprocket 29 is fixedly mounted on one end of the output shaft 19 remote from the clutch mechanism 20.

Figure 5:
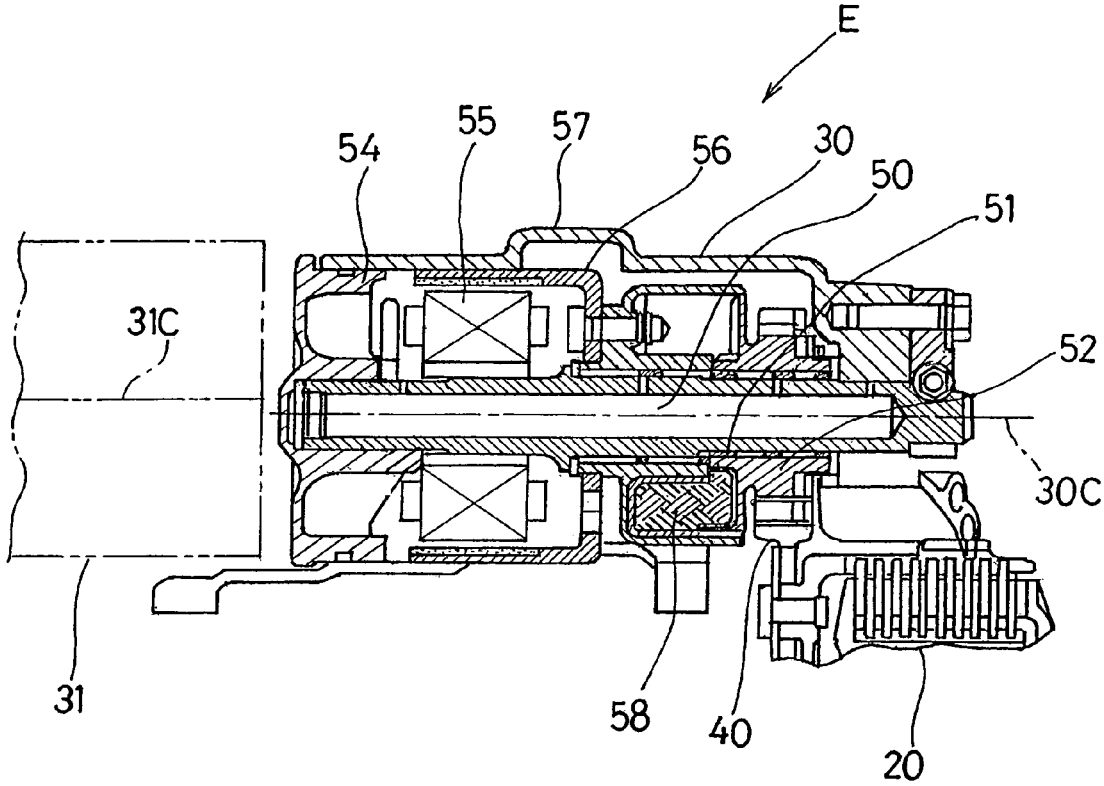
FIG. 5 is a fragmentary sectional view of a portion of the in-line multicylinder internal combustion engine, showing the relation between an electric generator and a clutch employed therein.

Referring now to FIG. 5, the electric generator 30 is of a structure including a stationary shaft 50, a drive gear 52 mounted on a tip end of the stationary shaft 50 through a bearing 51, a base 54 for supporting a left or base end of the stationary shaft 50, an annular coil assembly 55 fixed to the base 54 by means of a plurality of set bolts (not shown), a rotor 56 rotatably mounted around the coil assembly 55 and a casing 57 enclosing those component parts of the electric generator 30, with the drive gear 52 and the rotor 56 coupled with each other through a coupling damper 58.

The electric generator 30 is positioned closer to a widthwise intermediate portion of the combustion engine E than the clutch mechanism 20 and at the rear of the cylinder block CY The drive gear 52 of the electric generator 30 is meshed with the clutch gear 40 or a coupling gear so that the electric generator 30 can be driven at all times during revolution of the crankshaft 17. It is to be noted that the clutch gear 40 is fixedly mounted on the input shaft 18 and is drivingly associated with the crankshaft 17 at all times. In this embodiment, the clutch gear 40 mounted on the input shaft 18 is employed as the coupling gear that transmits the rotation of the crankshaft 17 to the electric generator 30. However, instead of the clutch gear 40, any other gear on the input shaft 18 can be used as a coupling gear.

The starter motor 31 is positioned on one side of the electric generator 30 and opposite the clutch mechanism 20 in the widthwise direction of the combustion engine E. Also, the electric generator 30 and the starter motor 31 have their respective axes 30C and 31C so arranged radially close to each other that, when viewed from the lateral side of the combustion engine E, the electric generator 30 may overlap partly with the starter motor 31.

With the combustion engine E so constructed as hereinbefore described, positioning of the electric generator 30 within a space defined above the plane M containing the respective axes 70 and 90 of the shafts 17 and 19 and between these shafts 17 and 19 is effective to reduce the total width of a lower region of the combustion engine E as compared with the conventional layout in which the electric generator 30A is arranged around one end of the crankshaft as shown by the phantom line in FIG. 2. Accordingly, when the combustion engine E is mounted on a motorcycle, the relatively large banking angle θ of the motorcycle, which represents the angle of lateral tilt of the motorcycle relative to the road surface R, can be obtained as compared with the banking angle θ1 that is obtained by the motorcycle employing such conventional layout.

Considering that, as shown in and described with reference to FIG. 3, the crankshaft 17, the input shaft 18 and the output shaft 19 are so arranged as to occupy respective vertexes of the triangular shape, when viewed laterally of the combustion engine E, with the crankshaft 17 and the input shaft 18 positioned below the output shaft 19, it can readily be understood that the combustion engine E can have a lowered center of gravity G.

Also, not only because of the reduction in the total width of the combustion engine E, but also because of reduction in length of the combustion engine E accomplished as a result of the generally triangular disposition of the shafts 17, 18 and 19 as discussed hereinabove, the combustion engine E as a whole can advantageously be assembled compact in size. In other words, comparing the combustion engine E with the conventional combustion engine for a given engine size, the present invention makes it possible that the cylinder bores can have an increased diameter along with reduction in piston stroke so that a large output can be easily obtained from the combustion engine E.

While the center of gravity G (FIG. 1) of the combustion engine E is generally positioned in the vicinity of the rear surface of the cylinder block CY, the electric generator 30 is positioned above the plane M containing the respective axes 70 and 90 of the crankshaft 17 and the output shaft 19, that is, in the vicinity of the rear surface of the cylinder block CY and is hence positioned in the vicinity of the center of gravity G of the combustion engine E. Accordingly, the mass centering in the combustion engine E can advantageously be accomplished, allowing the motorcycle with the combustion engine E to exhibit an increased performance. Also, since the electric generator 30 is of the design in which the drive gear 52 is directly meshed with the clutch gear 40 as shown in FIG. 5 and is not of a type driven by a chain through the sprocket such as in the Japanese Laid-open Publication No. 58-065936, an undesirable increase of the number of component parts employed and that of the weight can advantageously be suppressed.

As shown in FIGS. 4 and 5, the clutch mechanism 20 including the clutch gear 40 mounted thereon is disposed laterally of the combustion engine E, the electric generator 30 and the starter motor 31 are disposed nearer a widthwise intermediate portion of the combustion engine E than the clutch gear 40, and the electric generator 30 and the starter motor 31 have their respective axes 30C and 31C positioned radially close to each other in parallel with the axis 70 of the crankshaft 17. Accordingly, not only the electric generator 30 but also the starter motor 31 is positioned in the vicinity of the center of gravity G of the combustion engine E and, therefore, the centering of the mass on and in the vicinity of the center of gravity G of the motorcycle combustion engine E can be facilitated, resulting in increase of the performance of the motorcycle employing the combustion engine E.

Also, considering that the engine casing EC including the engine cylinder CY and the crankcase CR is of a two-piece structure made up of the upper and lower casing components C1 and C2, and the crank shaft 17 and the output shaft 19 are positioned on the plane M of the joint interface between the upper and lower casing components-C1 and C2, bearing holes for the crankshaft 17 and the output shaft 19 can easily be formed in the engine casing EC.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, considering that the drive gear 52 of the electric generator 30 shown in FIG. 5 may be engaged with any coupling gear mounted on the input shaft 18 and constantly drivingly associated with the crankshaft 17, this coupling gear may not be always the clutch gear 40, but may be either formed integrally with the clutch gear 40 or any other gear separate from the clutch gear 40. Also, although the imaginary plane H containing the respective axes 70 and 80 of the crankshaft 17 and the input shaft 18 lies substantially horizontally in the foregoing embodiment, in some cases, the imaginary plane H may be inclined relative to a horizontal plane or the road surface R.

Accordingly, such changes and modifications are, unless they depart from the scope of the present invention as delivered from the claims annexed hereto, to be construed as included therein.

What is claimed is:

1. An in-line multicylinder combustion engine which comprises:

a crankshaft having a crankshaft axis;

an input shaft having an input axis and drivingly connected with the crankshaft through a clutch gear, a first imaginary plane containing the crankshaft axis and the input axis;

an output shaft having an output axis and drivingly connected with the input shaft, the output axis being positioned above the first imaginary plane;

an electric generator having a generator longitudinal axis and also having a drive gear, the electric generator being positioned between the crankshaft and the output shaft with the generator longitudinal axis positioned above a second imaginary plane inclined to contain the crankshaft axis and the output axis, the drive gear of the electric generator also being operatively connected with the clutch gear functioning as a coupling gear that is mounted on the input shaft and constantly drivingly connected with the crankshaft;

a clutch mechanism having the clutch gear mounted thereon and positioned laterally of the combustion engine;

a starter motor having a motor longitudinal axis, wherein the electric generator and the starter motor are positioned closer to a widthwise intermediate portion of the combustion engine than the clutch mechanism, with the generator and starter longitudinal axes held radially close to each other, such that the electric generator and the starter motor overlap relative to each other when viewed from the lateral side of the combustion engine and wherein the starter motor is connected to the crankshaft through a coupling unit different from the clutch gear through which the drive gear of the electric generator is connected to the crankshaft; and an engine casing including a cylinder block and a crankcase, the engine casing comprising an upper casing component and a lower casing component separatable from each other, and wherein the crankshaft and the output shaft are positioned on a plane of joint interface between the upper and lower casing components, wherein a center axis of the cylinder block lies substantially perpendicular to the plane of joint interface between the upper and lower casing components.

2. The in-line multicylinder combustion engine as claimed in claim 1, wherein the first imaginary plane lies substantially horizontally.

3. The in-line multicylinder combustion engine as claimed in claim 1, wherein the coupling unit includes a drive gear of the starter motor, a starter gear connected with one end of the crankshaft through a one-way clutch, and an idle gear connecting the drive gear of the starter motor and the starter gear.

4. The in-line multicylinder combustion engine as claimed in claim 3, wherein the drive gear of the generator is positioned on one side of the crankshaft while the drive gear of the starter motor is positioned on the opposite side of the crankshaft.

5. In a compact motorcycle engine having a plurality of pistons mounted in respective cylinders, the plurality of pistons connected to a crankshaft, an input shaft drivingly connected to the crankshaft and an output shaft drivingly connected to the input shaft, the improvement comprising:

an axis of the input shaft and an axis of the crankshaft define a first line H in a first plane, the axis of the crankshaft and an axis of the output shaft define a second line M within a second plane, wherein the axis of the output shaft is above the axis of the input shaft and when the first line H is approximately horizontal, the second line M is inclined downwardly from the axis output shaft to the axis of the crankshaft, wherein axes of movement of the respective cylinders are perpendicular to the second line M.

6. The compact motorcycle engine of claim 5 wherein a starter motor and an electric generator are operatively mounted above the second line M when viewed from a lateral side of the motorcycle engine.

7. An in-line multicylinder combustion engine which comprises:

a crankshaft having a crankshaft axis;

an input shaft having an input axis and drivingly connected with the crankshaft through a clutch gear, a first imaginary plane containing the crankshaft axis and the input axis;

an output shaft having an output axis and drivingly connected with the input shaft, the output axis being positioned above the first imaginary plane;.

an electric generator having a generator longitudinal axis and also having a drive gear, the electric generator being positioned between the crankshaft and the output shaft with the generator longitudinal axis positioned above a second imaginary plane inclined to contain the crankshaft axis and the output axis, the drive gear of the electric generator also being operatively connected with the clutch gear functioning as a coupling gear that is mounted on the input shaft and constantly drivingly connected with the crankshaft; and an engine casing including a cylinder block and a crankcase, the engine casing comprising an upper casing component and a lower casing component separable from each other, wherein the crankshaft and the output shaft are positioned on a plane of a joint interface between the upper and lower casing components;

wherein a center axis of the cylinder block lies substantially perpendicular to the plane of the joint interface between the upper and lower casing components.

8. An in-line multicylinder combustion engine which comprises:

a crankshaft having a crankshaft axis;

an input shaft having an input axis and drivingly connected with the crankshaft through a clutch gear, a first imaginary plane containing the crankshaft axis and the input axis;

an output shaft having an output axis and drivingly connected with the input shaft, the output axis being positioned above the first imaginary plane;

an electric generator having a generator longitudinal axis and also having a drive gear, the electric generator being positioned between the crankshaft and the output shaft with the generator longitudinal axis positioned above a second imaginary plane inclined to contain the crankshaft axis and the output axis, the drive gear of the electric generator also being operatively connected with the clutch gear functioning as a coupling gear that is mounted on the input shaft and constantly drivingly connected with the crankshaft;

a clutch mechanism having the clutch gear mounted thereon and positioned laterally of the combustion engine; and a starter motor having a motor longitudinal axis, wherein the electric generator and the starter motor are positioned closer to a widthwise intermediate portion of the combustion engine than the clutch mechanism, with the generator and starter longitudinal axes held radially close to each other, such that the electric generator and the starter motor overlap relative to each other when viewed from the lateral side of the combustion engine and wherein the starter motor is connected to the crankshaft through a coupling unit different from the clutch gear through which the drive gear of the electric generator is connected to the crankshaft, the coupling unit includes a drive gear of the starter motor, a starter gear connected with one end of the crankshaft through a one-way clutch, and an idle gear connecting the drive gear of the starter motor and the starter gear, wherein the drive gear of the generator is positioned on one side of the crankshaft while the drive gear of the starter motor is positioned on the opposite side of the crankshaft.

9. The in-line multicylinder combustion engine as claimed in claim 8, wherein the first imaginary plane lies substantially horizontally.

10. the in-line multicylinder combustion engine as claimed in claim 8, further comprising an engine casing including a cylinder block and a crankcase, the engine casing comprising an upper casing component and a lower casing component separatable from each other, and wherein the crankshaft and the output shaft are positioned on a plane of joint interface between the upper and lower casing components.

11. The in-line multicylinder combustion engine as claimed in claim 10, wherein a center axis of the cylinder block lies substantially perpendicular to the plane of joint interface between the upper and lower casing components.

* * * * *